United States Patent [19]

Ellis et al.

[11] Patent Number: 4,538,703

[45] Date of Patent: Sep. 3, 1985

[54] CLIMBING AID AND SAFETY DESCENT SYSTEM

[75] Inventors: J. Nigel Ellis, Wilmington, Del.; Meyer Ostrobrod, Philadelphia, Pa.

[73] Assignee: Research & Trading Corporation, Wilmington, Del.

[21] Appl. No.: 628,893

[22] Filed: Jul. 9, 1984

Related U.S. Application Data

[63] Continuation-in-part of Ser. No. 430,244, Sep. 30, 1982, Pat. No. 4,458,781.

[51] Int. Cl.[3] ..... A62B 1/10; A62B 35/02

[52] U.S. Cl. ..... 182/5; 182/8; 182/10; 182/234; 182/239

[58] Field of Search ..... 182/5–7, 182/8, 10, 11, 190, 191, 192, 193

[56] References Cited

U.S. PATENT DOCUMENTS

| | | | |
|---|---|---|---|
| 151,007 | 5/1874 | Bustin | 182/11 |
| 387,772 | 8/1888 | Debus | 182/5 |
| 405,945 | 6/1889 | Bruce | 182/192 |
| 697,736 | 4/1902 | Mahar | 182/191 |
| 3,703,218 | 11/1972 | Brda | 182/193 |
| 3,729,068 | 4/1973 | Fuller | 182/5 |
| 4,359,946 | 11/1982 | Marvin | 182/10 |
| 4,458,781 | 7/1984 | Ellis | 182/5 |

*Primary Examiner*—Reinaldo P. Machado
*Attorney, Agent, or Firm*—Russell, Georges, Breneman, Hellwege & Yee

[57] ABSTRACT

A safety system which permits the free movement of the user, assists the ascent of the user and provides a reduced, controlled rate of descent in the event of an emergency descent or a fall, includes a cable attachable at one end to the user and secured at the other end to a moveable counterweight assembly. Intermediate its ends the cable passes over a pulley in a controlled descent device which also includes a centrifugally-actuated clutch coupling the pulley to a speed-multiplying gearing system and a centrifugally-operated braking assembly. Under normal-use conditions, the pulley is rotated at sufficiently low speeds to preclude engagement of the clutch, and the user has free movement, with a component of the counterweight assisting the ascent of the user. In the event of a rapid rate of descent, the increased rotational speed of the pulley is coupled to and actuates the braking assembly to reduce the rotation of the pulley and slow the descent to a lower, controlled rate. Descent may be vertically or at an angle with a spring pulley and an angled descent cable. The cable may be disposed on the pulley in different arrangements, and the pulley may be provided with alternate groove configurations. The pulley may be coupled to the braking assembly without an intervening clutch.

53 Claims, 18 Drawing Figures

FIG. 1.
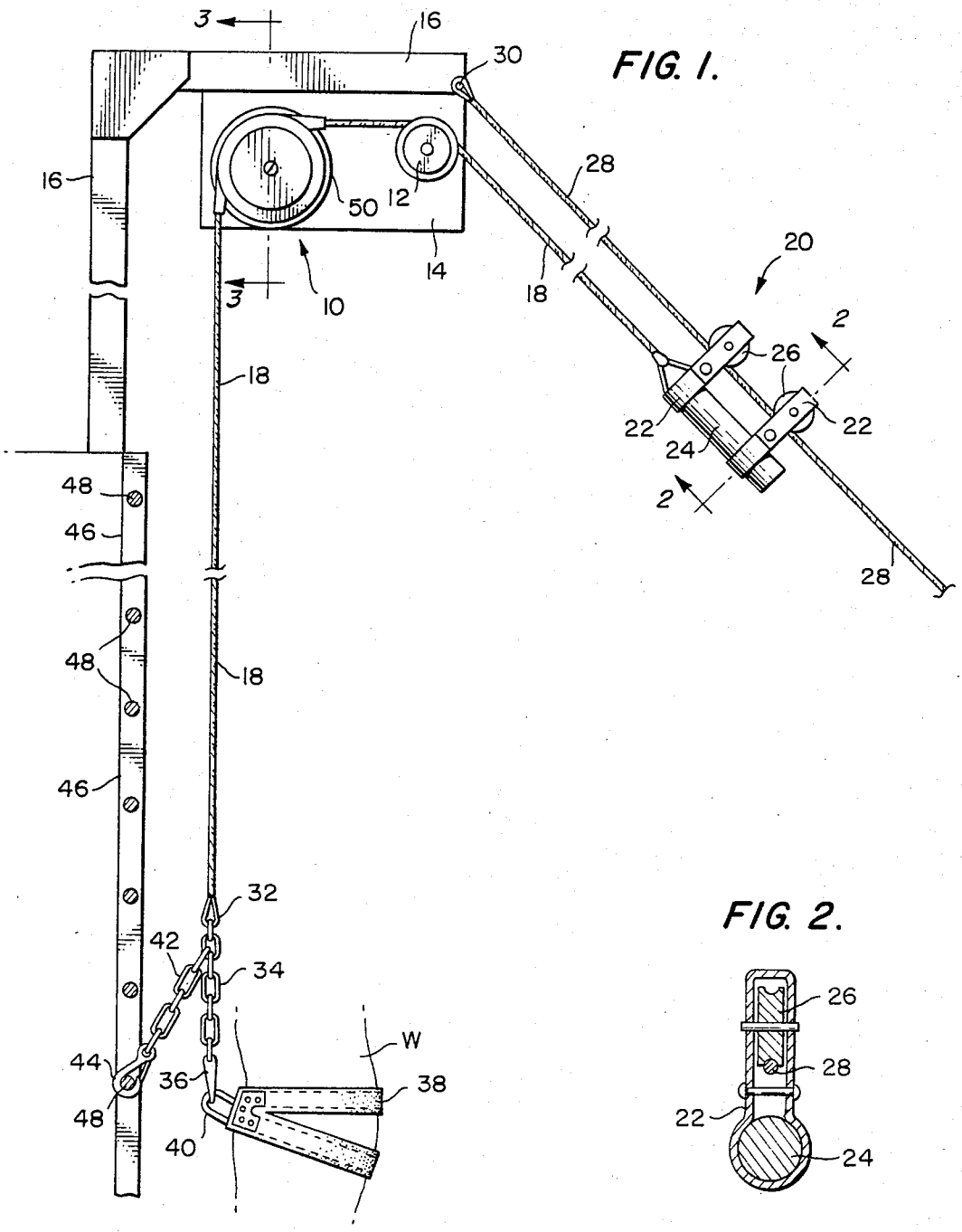
FIG. 2.
FIG. 4.
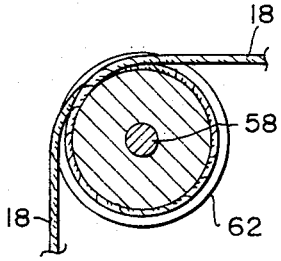

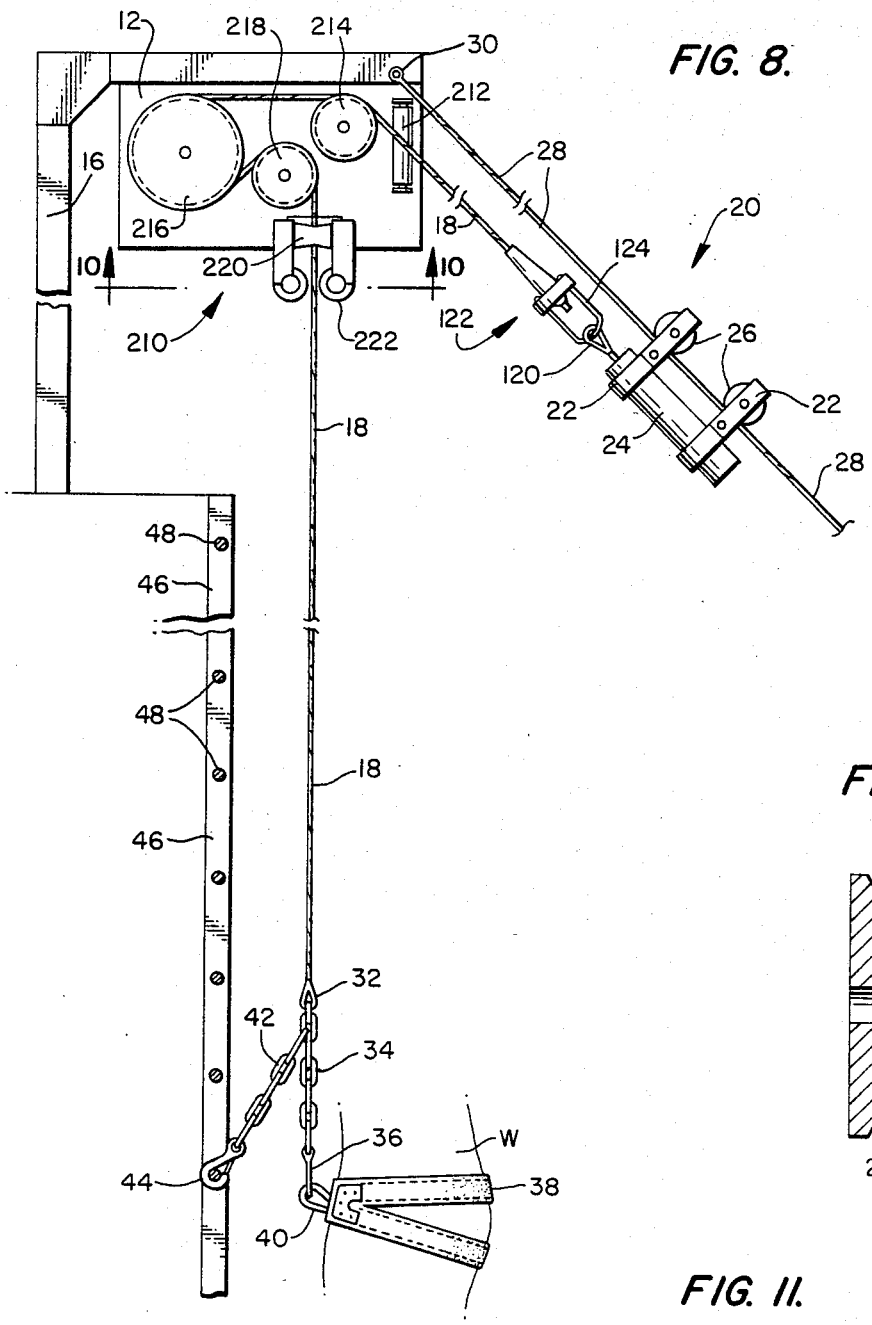
FIG. 8.
FIG. 13.
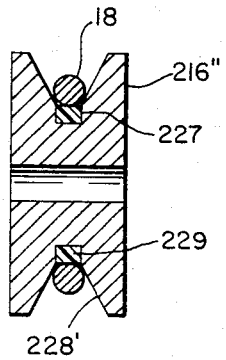
FIG. 11.
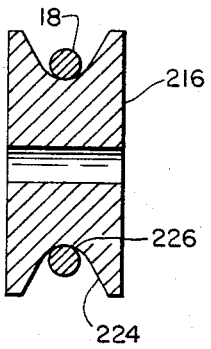
FIG. 12.
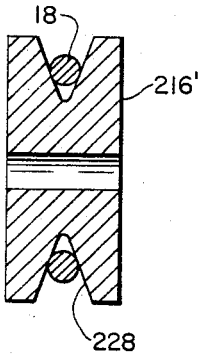

CLIMBING AID AND SAFETY DESCENT SYSTEM

CROSS REFERENCE TO COPENDING APPLICATION

This application is a continuation-in-part of copending application Ser. No. 430,244, filed on Sept. 30, 1982 and now U.S. Pat. No. 4,458,781.

BACKGROUND OF THE INVENTION

1. Field of the Invention

This invention relates generally to safety equipment, and more particularly to such equipment used for the safe ascent and descent of the user. More specifically, the present invention relates to a safety system which assists the user during the ascent, permits free movement in ascent and descent during normal conditions and in the event of a too-rapid descent, such as a fall, the system operates to reduce the descent rate to a slower, controlled rate.

2. Prior Art

The following prior art is of record in the aforesaid copending application:

U.S. Pat. No. 511,896, Killeen, Jan. 2, 1894
U.S. Pat. No. 1,123,776, Meyer, Jan. 5, 1915
U.S. Pat. No. 1,849,725, Quick, Mar. 15, 1932
U.S. Pat. No. 2,280,396, Gentry, Apr. 21, 1942
U.S. Pat. No. 2,538,904, Herod, Jan. 23, 1951
U.S. Pat. No. 3,467,224, Curtis et al., Sept. 16, 1969
U.S. Pat. No. 3,826,335, Allen, July 30, 1974
U.S. Pat. No. 3,908,791, Kleine et al., Sept. 30, 1975
U.S. Pat. No. 3,946,989, Tsuda, Mar. 30, 1976
U.S. Pat. No. 4,111,281, Jacobs, Sept. 5, 1978
U.S. Pat. No. 4,130,176, Paulie, Dec. 19, 1978
U.S. Pat. No. 4,252,214, Miller, Feb. 24, 1981
U.S. Pat. No. 163,705 (Switz.), Dingeldein, Nov. 1, 1933

SUMMARY OF THE INVENTION

Among the objects of the invention are to provide an improved climbing aid and safety descent system for the safe ascent and descent between different elevations, to provide an improved system of the foregoing type which aids the ascent by counterbalancing a portion of the user's weight, to provide an improved system of the foregoing type having a controlled descent mechanism capable of reducing high rates of descent to a lower, controlled rate of descent, and to provide an improved system of the foregoing type which permits free movement of the user during normal use and which operates to provide a controlled rate of descent in the event of an emergency such as a fall or need for rapid descent.

Other objects of the invention are to provide a climbing aid and safety descent system of the foregoing type with an improved controlled descent device having a cable controller which permits free movement of the user during normal-use conditions and which operates in the event of a too-rapid descent to provide a controlled rate of descent, to provide an improved device of the foregoing type with a novel braking assembly, and to provide an improved device of the foregoing type with a centrifugally-actuated clutch coupling the cable controller with the braking assembly.

These and other objects of the invention are achieved in a climbing aid and safety descent system which includes a main cable attachable at one end to the safety harness of the user and attached at the other end to a counterweight assembly disposed for traversal along a guide wire. Intermediate its ends the cable passes over a cable pulley in a controlled descent device which also includes a centrifugally-actuated clutch coupling the pulley to a speed-multiplying gearing system and a centrifugally-operated braking assembly. Under normal-use conditions, the force of the counterweight assembly at one end of the cable and the weight of the user at the other end causes the cable to rotate the pulley at sufficiently low speeds to preclude engagement of the clutch, and the user has free movement with the system, with a component of the counterweight assisting the ascent of the user.

In the event of a rapid rate of descent, such as a fall or an emergency intentional rapid descent, the increased rotational speed of the pulley activates the clutch to couple the rotation of the pulley to the braking assembly, with the gearing system multiplying the rotational speed. The braking assembly reduces the rotation of the pulley and slows the descent to a lower, controlled rate. Descent may be vertically or at an angle along a second, angled guide cable.

Alternate embodiments of the controlled descent device include disposing the main cable at least one complete revolution around the cable pulley and, in cooperation with guide pulleys, disposing the cable less than a complete revolution around the pulley. The pulley itself may be provided with a straight-sided, flat bottomed groove, or a groove of U-shaped or V-shaped configuration. The V-chaped pulley may be provided with a friction enhancing surface at the base of the groove. The cable pulley may be directly coupled to the braking assembly by the gearing system, without an intervening clutch.

BRIEF DESCRIPTION OF THE DRAWINGS

FIG. 1 is a schematic illustration of one embodiment of the present invention;

FIG. 2 is a cross-sectional view of the invention, as along line 2—2 in FIG. 1;

FIG. 4 is an elevational cross-sectional view, on a reduced scale, as seen along line 4—4 in FIG. 3;

FIG. 8 schematically illustrates another embodiment of the present invention;

FIG. 11 is a cross-sectional view of another embodiment of the pulley in the controlled descent mechanism;

FIG. 12 is a view similar to FIG. 11 showing yet another embodiment of the pulley;

FIG. 13 is a cross-sectional view showing a modification of the pulley of FIG. 12;

DETAILED DESCRIPTION OF THE PREFERRED EMBODIMENTS

Figure 3:
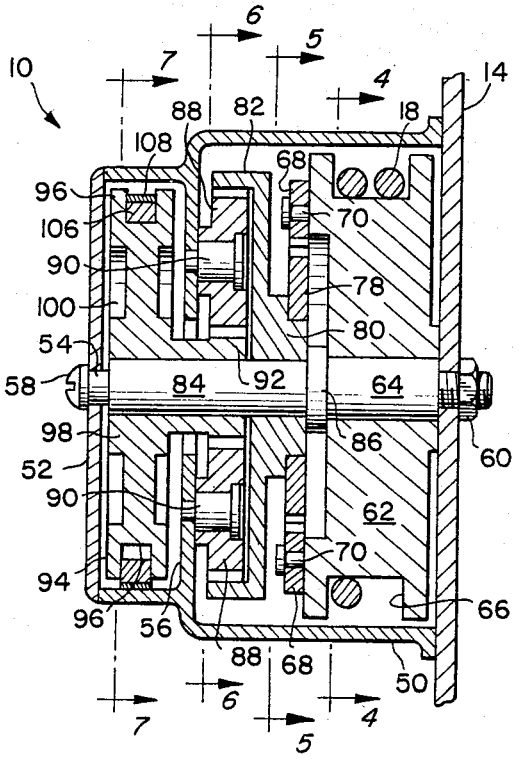
FIG. 3 is a cross-sectional view of the invention, as seen along line 3—3 in FIG. 1.

Referring more particularly to FIG. 1, the climbing aid and safety descent system of the present invention is shown to include a controlled descent mechanism, indicated generally at 10, which, together with a guide pulley 12, is mounted on a plate 14 securely but removably attached to a support 16. A main cable 18 passes over the controlled descent mechanism 10, passes over the guide pulley 12, and attaches at one end to a counterweight assembly or trolley indicated generally at 20. The counterweight assembly 20 includes a pair of frame members 22, one end of each being attached to a weight 24, with the other end rotatably supporting a roller 26. The end of the cable 18 is connected by conventional means to the weight 24.

A guide wire 28 is securely attached at its upper end to the support 16, such as at the point 30, and is anchored at its other end at an elevation (not shown) lower than the support. The rollers 26 of the counterweight assembly 20 traverse the guide wire 28 to move the counterweight assembly substantially parallel to the guide wire. The cross-sectional view of FIG. 2 shows more clearly the relationship between the counterweight assembly 20 and the rollers 26 moving along the guide wire 28.

With continuing reference to FIG. 1, the other end of the main cable 18 is provided with an eye 32 to which is connected a flexible member 34, such as a length of cable or a length of chain as shown, with a snap hook 36 or similar quick-connect fastener being attached to the free end of the flexible member. A worker W using the system of the present invention has a safety belt or harness 38 provided with a ring 40 to which the snap hook 36 may be readily connected. A second flexible member 42, which may also be a length of cable or a length of chain as shown, in connected at one end to the eye 32, with the remaining end being provided with another snap hook or similar quick-connect fastener 44.

A ladder 46 having a plurality of vertically-spaced rungs 48 is securely attached to the structure to which the support 16 is attached. As described more fully below, the climbing aid and safety descent system of the present invention permits the worker W to ascend the ladder 46 with greater ease and to descend quickly from the structure at a controlled rate in the event of an emergency.

Prior to use, both snap hooks 36 and 44 are connected to a ladder rung 48 or another convenient point. To use, the worker W wearing the safety harness 38 first attaches one end of the main cable 18 to the harness by connecting the snap hook 36 to the ring 40, with the snap hook 44 on the end of the flexible member 42 remaining connected to a rung 46 of the ladder 48 for safety reasons. When the worker W is ready to move, the snap hook 44 is then disconnected from the ladder rung 48 and conveniently attached to the ring 40. Attachment of the flexible member 42 to the ladder 48 when the worker W stops temporarily provides a safety connection to the ladder. With the counterweight assembly 20 provided in the system of the present invention, the ascent of the worker W is facilitated to the extent that a component of the weight 24 applies an upward pull to the worker by the main cable 18, thus counter-acting a portion of the worker's weight and making it easier for the worker to ascend the ladder 48.

The value of weight 24 need not be equal to the weight of the worker W for the present system to work properly and effectively, and in many applications weight 24 will be less than the worker's weight. However, if desired, or in order to comply with applicable regulations, e.g., OSHA Program Directive 100-103, the weight 24 may be equal to the weight of the worker W.

When the worker W has finished using the system, the foregoing procedure is reversed, by first detaching one of the snap hooks 36 and 44 from the ring 40 and connecting it to a ladder rung 48 or another convenient anchor point before disconnecting the remaining snap hook from the ring.

As shown in FIG. 3, the controlled descent mechanism 10 includes a housing or enclosure 50 open at both ends, with one end abutting against the plate 14 and the other end being closed by a plate 52 having a central aperture 54. A short distance inward, toward the plate 14, from the closure plate 52 the housing 50 is provided with an annular flange 56 which extends radially inwardly and terminates in a central opening. A shaft 58, which may conveniently have a threaded end portion, is passed through the central aperture 54 in the plate 52 and through the central opening in the annular flange 56, and through an opening in the plate 14, pass the back surface of the plate. A fastener, such as a nut 60, is threaded upon the shaft 58 to securely, but removably, mount the housing 50 and the controlled descent device 10 to the plate 14.

A pulley 62, rotatably supported on the shaft 58 by a tubular sleeve 64, has a groove or recess 66 around its peripheral surface to receive the main cable 18. As noted above, and as shown in FIG. 4, the cable 18 is wrapped one complete turn around the pulley 62, with the cable extending more than one turn from the point it makes initial contact with the pulley until it leaves the pulley.

Figure 5:
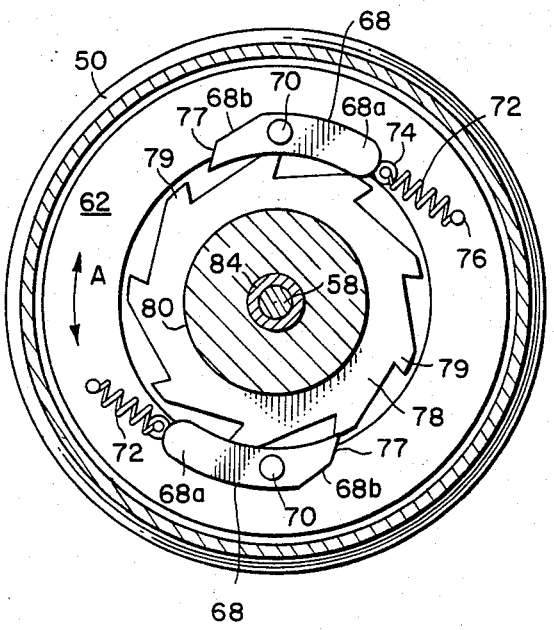
FIG. 5 is an elevational cross-sectional view, as seen along line 5—5 in FIG. 3.

Supported diametrically on one surface of the pulley 62, the surface facing away from the plate 14, is a pair of arcuate, pawl-like elements 68 rotatable about pivots 70. Each of the pawl elements 68 is rotatably supported off-center on the pivot 70 such that the pawl is unbalanced relative to the axis of the pivot. The end 68*a* of the pawl 68 furthest from the axis 70 is biased clockwise by a spring 72 attached at its ends by a pin 74 secured to the end of the pawl and a pin 76 fixed to the surface of the pulley 62, as shown in FIG. 5. This end 68*a* of the pawl 68 is smoothly contoured. The other end 68*b* of the pawl-like element 68, the end closer to the axis 70, is provided with an angular, plane surface 77. A disk 78, having a plurality of teeth-like projections 79 on its periphery, is securely attached to a hub 80 of a crown or ring gear 82. The pawl-like elements 68 and the disk 78 function as a clutch to selectively transmit rotational motion of the pulley 62 to the other portions of the controlled descent mechanism 10, as described below.

The ring gear 82 is provided with teeth 83 extending radially inwardly from its outer circumference, and is rotatably supported on the shaft 58 by a coaxial tubular sleeve 84 extending through the hub 80. An axial spacer 86 is disposed between the pulley 62 and the hub 80 to permit free, relative rotation between the pulley and the ring gear 82, and thus the free rotation of the disk 78 relative to the pulley and the pawl-like elements 68 supported on the pulley.

Two idler or planetary gears 88, rotatably supported by studs 90 fixed onto the annular flange 56, mesh with the teeth 83 of the ring gear 82 and with a center or sun gear 92 which is also rotatably supported on the shaft 58 by the sleeve 84. Note FIGS. 3 and 6. A brake holder 94, having adjacent its outer peripheral rim 96 a recessed channel or groove 98, has a central hub 100 which rotatably supports the brake holder on the shaft 58 by means of the tubular sleeve 84. Note FIGS. 3 and 7. Conveniently, the body of the center or sun gear 92 may be an axial extension of the hub 100 of brake holder 94, as shown in FIG. 3.

Figure 6:
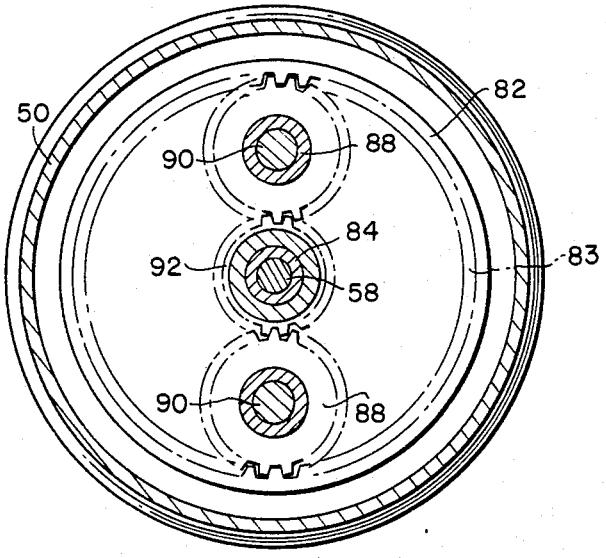
FIG. 6 is an elevational cross-sectional view, as seen along line 6—6 in FIG. 3.

As shown in FIG. 6, with the meshing of the ring or crown gear 82 with the idler gears 88 and the center or sun gear 92, rotation of the ring gear is transmitted, at a multiplied rate, to the sun gear since the idler gears are fixed onto stationary annular flange 56 of the mechanism housing 50. This operation will be further described below.

Figure 7:
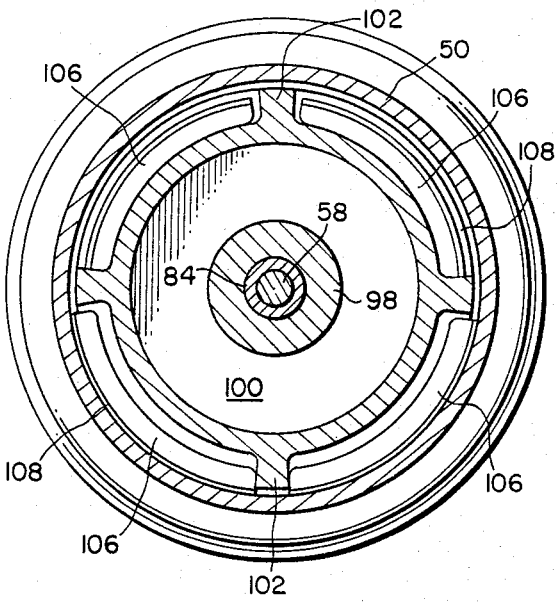
FIG. 7 is an elevational cross-sectional view, as seen along line 7—7 in FIG. 3.

Referring to FIGS. 3 and 7, the channeled or the grooved recess 98 in the outer periphery 96 of the brake holder 94 is joined to the hub 100 by an annular flange 102. As shown in FIG. 7, at regular intervals along the circumference, the channel 98 of the brake holder 94 is interrupted by radially-extending guides or dividers 104, to define annular receiving sectors or recesses in which are received brake elements 106 in the form of arcuate weights. The brake elements 106 can move freely radially outwardly and inwardly within the recesses under the influence of rotation of the brake holder 94, but can move only to a very limited extent in the circumferential direction of the brake holder. The outer surface of each of the brake elements 106 is covered with a layer 108 of friction material, such that upon rotation of the brake holder 94 and radial movement outwardly of each of the brake elements 106 under centrifugal force, the friction layer will engage the inner surface of the housing 50, thus creating a dragging or braking action between the brake holder and the stationary housing.

From the foregoing, it can be seen that the controlled descent mechanism 10 has two modes of operation. Under normal conditions, with the cable 18 passing slowly over the pulley 62 and the pulley rotating below a predetermined speed, there is no engagement between the pawl-like elements 68 and the disk 78. This permits the free, unhindered movement of the main cable 18 over the pulley 62, and the worker W is able to move freely up and down. In the arresting mode, when the cable passes rapidly over the pulley 62 to rotate the pulley above a predetermined speed, there is operative engagement between the pulley 62 and the brake holder 94.

More specifically, under normal conditions, as the worker W moves up and down on the ladder 46, his weight at one end of the cable 18 and the counterweight assembly 20 at the other end will cause the cable to rotate slowly the pulley 62, in either direction A (FIG. 5). Under these normal conditions, the force of the pawl spring 72 is sufficient to bias the shaped, plane end surfaces 77 of the pawls 68 out of engagement with the teeth-like elements 79 on the disk 78. The arcuate configuration of the inner edge surface of the pawl-like element 68 and the smooth contour of the end **68*a* causes each pawl to ride over the teeth-like elements 78 on the disk 78, against the bias of the springs 72, without engagement between these two structures. At the same time, the springs 72 bias the pawl ends 68*b* away from the teeth 79 on the disk 78. Thus, under normal operating conditions there is no coupling between the pulley 62 and the disk 78 and the brake holder 94. The brake holder 94 is inoperative, and the pulley 62** is freely rotatable.

However, in the event of a too-rapid descent of the worker W, such as a fall, the pulley 62 is rotated at a speed sufficient for the centrifugal force acting on the longer, off-centered portion **68*a* of the pawls 68 to overcome the restraint of the springs 72. The pawls 68 then rotate counterclockwise about the pivots 70, against the pull of the spring 72, causing the shaped ends 77 to engage the teeth 79 and mechanically coupling the rotating pulley 62 to the gearing system through the disk 78 fixed to the hub of the ring gear 82. The rotational speed imparted to the disk 78 by the rotating pulley 62 is multiplied by the arrangements of the ring gear 82, the idler gear 88 and the center or sun gear 92, which in turn transmits the rotational motion to the brake holder 94**.

Rotation of the brake holder 94 causes the brake elements 106 to move radially outwardly to establish braking contact between the frictional material layer 108 and the inner surface of the enclosure 50. This braking force reduces the rapid rotation of the pulley 62, thus reducing the movement of the main cable 16 to a slower, controlled rate. The braking force is directly proportional to the rotational speed of the pulley 62, i.e., the rate of fall of the worker W, so that the more rapid the rate of fall of the worker, the greater is the rotational speed of the pulley, and the greater is the braking force produced by the controlled descent mechanism 10. The system will operate, in general, to safely lower the worker at a controlled descent rate of approximately 4 to 9 feet per second.

Once the rotating pulley 62 has slowed to a speed at which the centrifugal force exerted on the pawl-like elements 68 is not sufficient to overcome the restraint of the springs 72, then the springs rotate the pawl elements from the teeth 79 on the disk 78. This disengages the brake holder 94 and the gear assembly from the pulley, and the cable 18 again moves freely over the pulley 62.

An alternate embodiment of the climbing aid and safety descent system of the present invention is shown in FIG. 8. With the exception of the structure of the alternate embodiment of the controlled descent mechanism 210, the other elements in the system are substantially identical to that shown in FIG. 1, and the same reference characters are used.

Figure 9:
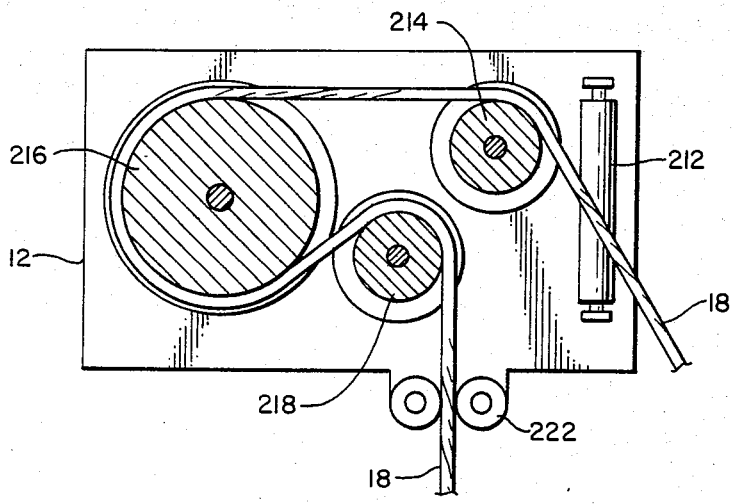
FIG. 9 shows, to a larger scale, the controlled descent mechanism of FIG. 8.
Figure 10:
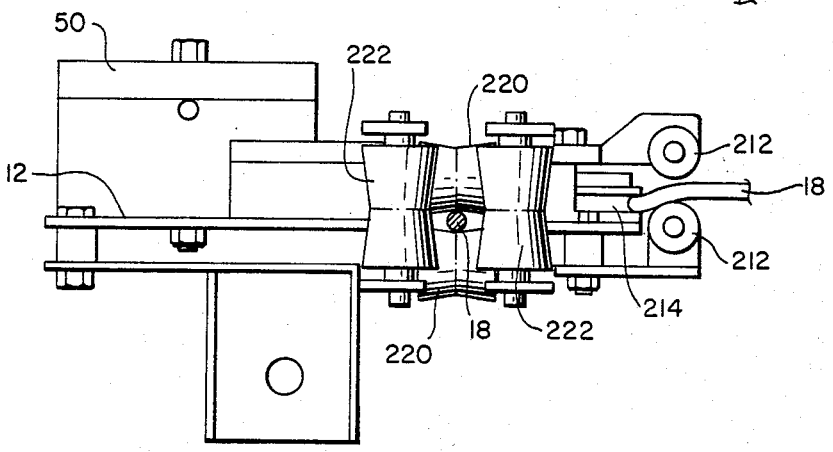
FIG. 10 is a sectional view of the controlled descent mechanism, as seen along line 10—10 in FIG. 8.

As shown in FIGS. 8, 9 and 10, the portion of the main cable 18 extending from the counterweight assembly 20 passes between a pair of parallel, vertically-disposed guide rollers 212, and over a first guide pulley 214 rotatably supported on a horizontally-disposed axis, before passing over a main or drive pulley 216 which is operatively coupled to the clutching mechanism, the speed-multiplying gearing system and the brake holder disposed within the housing 50. The clutching mechanism, gearing system and brake holder are structurally and functionally identical to that described above relative to the embodiment shown in FIGS. 1–7. A second guide pulley 218 is positioned relative to the main pulley 216 to cause the cable 18 to wrap around the pulley less than one complete revolution.

The cable 18, after passing over the second guide pulley 218, passes downwardly through the controlled descent mechanism 216, between two pairs of orthogonally-disposed guide rollers 220 and 222, as best shown in FIGS. 8 and 10. As shown, the guide rollers 220 and 222 are preferably provided with concave-shaped or otherwise indented peripheral surfaces to center the cable 18 therebetween, and at the same time to provide maximum freedom of movement for the cable.

As shown in FIG. 9, the first guide pulley 214 is supported on the plate 14 so that the cable 18 passes over the groove of the guide pulley in a substantially horizontal orientation, and contacts the main pulley 216 in a tangential fashion. As the cable 18 passes between the lower portion of the main pulley 216 and the second guide pulley 218, the cable is wrapped around the main pulley less than one complete revolution, or with somewhat less than 360 degrees of engagement between the cable and the circumference of the main pulley. It has been found that by wrapping the cable around the main pulley 216 in this manner, operation of the controlled descent mechanism 210 is substantially identical in efficiency and performance as the controlled descent mechanism 10 shown in FIGS. 1–7, in which the main cable 18 is wrapped one complete revolution around the main pulley 62.

Shown in FIG. 8 is one suitable technique for attaching the main cable 18 to the weight 24. An eyebolt 120 is threaded into an internally-threaded hole tapped into an end of the weight 24. The cable 18 is passed through and secured to a cable vise or strand vise 122 of known construction, with the loop 124 of the cable vise passing through the eyebolt 120.

The remainder of the system shown in FIG. 8 is identical to that of FIG. 1, and further description of the structure is not deemed necessary. Similarly, the operation of the control descent mechanism 210 is identical to that of the control descent mechanism 10, and will not be further described.

The main pulley 216, preferably, is provided with a tapered or convergent groove which, in cross section, has straight convergent sides 224 terminating in a curved or arcuate trough 226, somewhat resembling a U, as shown in FIG. 11. Alternatively, the straight sides of the groove can intersect in a V-shaped groove 228, as shown in the pulley 216' in FIG. 12. The groove configuration for the pulley 216 provides good, nonslip operating conditions up to a certain weight limit of the worker W, above which slippage may become evident. For heavier weights, the V-shaped groove shown in the main pulley 216' is recommended. With this groove configuration, the heavier weight pulls the cable 18 further into the convergent groove 228, thereby increasing the contact between the cable and the pulley. The angle of the sides of groove 228 is appropriately selected for the size of the pulley and the size of the main cable to be used.

FIG. 13 illustrates a modification of the pulley having a V-shaped groove. Pulley 216'' has a V-shaped groove 228' in which the base thereof has been provided with a recess 227 in which a member 229 is provided. The member 229 is of a material such as polyurethane or other suitable material which offers a high degree of slip resistance to the main cable 18. As shown, driving contact between the cable 18 and the pulley 216'' is principally via the member 229 which, due to material from which it is made, provides excellent rotating traction and negligible slippage of the cable regardless of the worker's weight. Any of the foregoing-described pulley groove configurations may be similarly provided with a traction-improving member.

Figure 14:
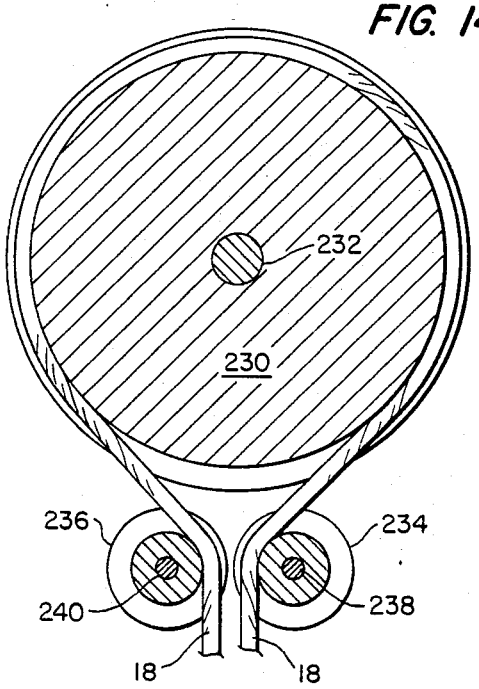
FIG. 14 is a sectional view of another embodiment of the cable and pulley arrangement in the controlled descent mechanism.

An alternate embodiment of the single cable wrap configuration of the main pulley 216 is shown in FIG. 14, in which a main pulley 230 is rotatably disposed about a shaft 232 and the main cable 18 for the system is wrapped once around the peripheral groove of the pulley. The cable 18 passes between a pair of guide rollers 234 and 236 which are oriented along a common horizontally-disposed axis and positioned below the lowermost circumferential point of the pulley 230. As shown, preferably the guide pulleys 234 and 236 are smaller than the main pulley 230, with a guide pulley disposed on either side of an axis extending vertically through the main pulley, in the orientation of FIG. 14. The guide pulleys 234 and 236 are rotatably supported on a shaft 238 and 240, respectively, with the shafts spaced appropriately to permit the unencumbered passage of the cable 18 up, over, and down from the main pulley 230. While not specifically shown in FIG. 14, one portion of the cable 18 leads to the counterweight assembly 20 and the other portion leads to the safety harness 38 of the worker W. The pulley 230 may have the U-shaped groove of FIG. 11, or the V-shaped groove of FIG. 12 or FIG. 13.

It is understood that the combination of the main pulley 230 and the parallel-disposed guide pulleys 234 and 236 of FIG. 14 would be incorporated into the controlled descent mechanism 210, in place of the main pulley 216 and guide pulleys 214 and 218. The pulley 230 would be operatively coupled to the clutching, gearing and braking mechanisms already described to provide free, unencumbered passage of the cable 18 over the pulley during normal operation of the system, and to provide braked, controlled descent of the worker W during emergency situations.

Figure 15:
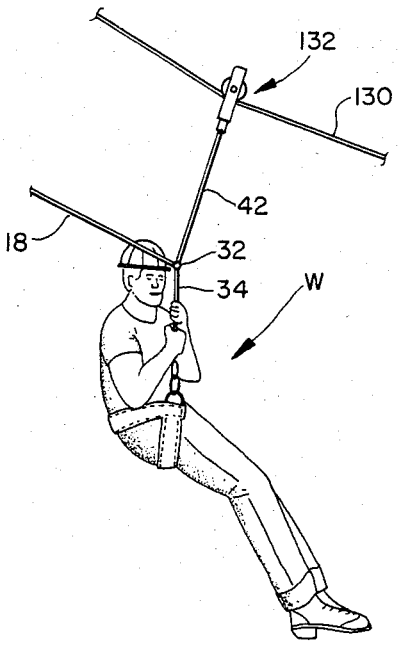
FIG. 15 illustrates an angled descent mode using the present invention.

In the invention described above, the descent, whether intentional or accidental, has been substantially vertical. It may be desired to descend from the structure at an angle away from the base thereof. As shown in FIG. 15, an angled descent at a controlled rate can be readily achieved with the system of the invention. A separate descent cable or wire 130 is securely anchored at its ends, at an appropriate angle and suitably convenient for access by the worker W. A descent pulley assembly 132, to which the main cable 18 can be readily connected, provides a rapid, controlled angled descent along the cable 130.

Figure 16:
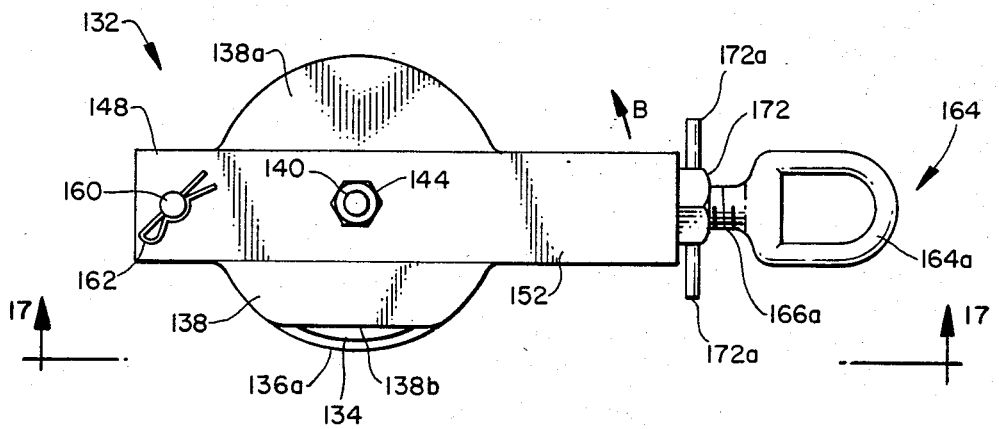
FIG. 16 is a plan view of a pulley used in the angled descent mode of FIG. 15.
Figure 17:
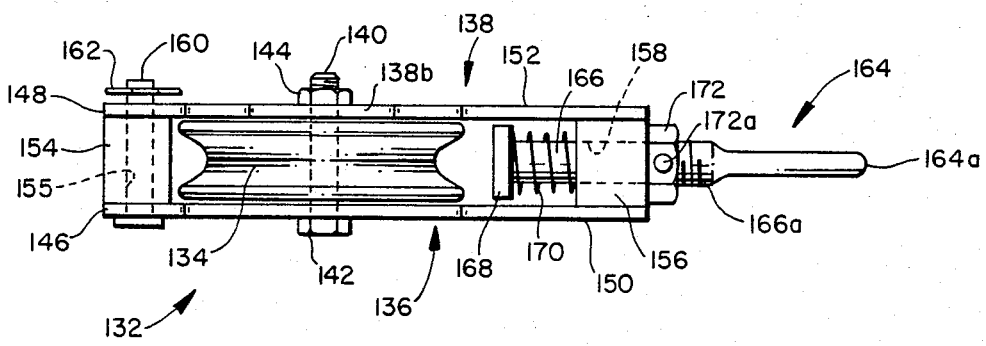
FIG. 17 is a view of the pulley as seen along line 17—17 in FIG. 16.
Figure 18:
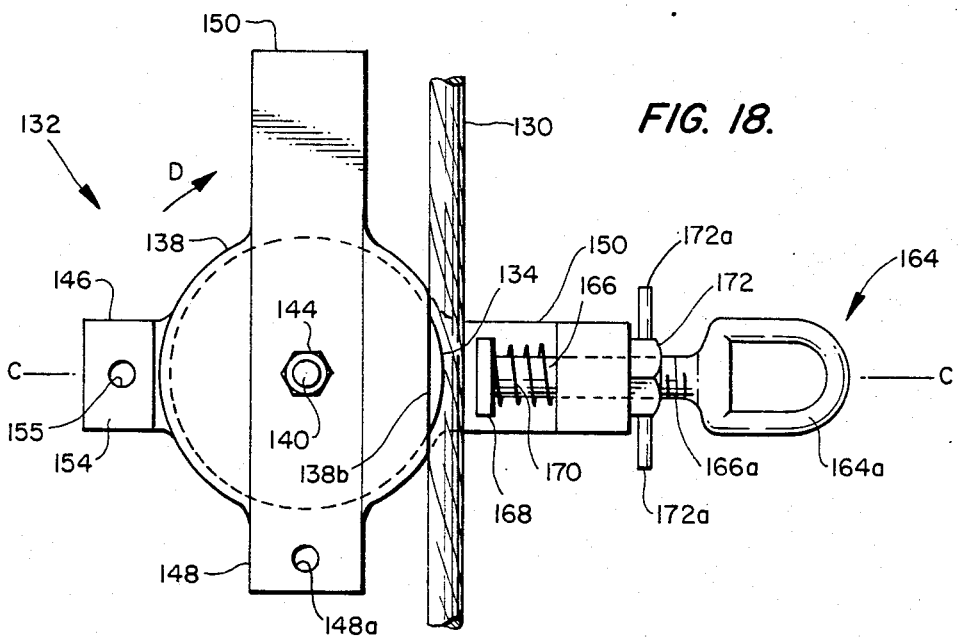
FIG. 18 is a view similar to FIG. 16, showing an intermediate step in placing the pulley on a cable.

The structure and operation of the descent pulley assembly 132 can be appreciated by reference to FIGS. 16, 17 and 18. A pulley 134 is disposed between plates 136 and 138, and is rotatable about a shaft 140 extending through the plates. As shown the shaft 140 may have an enlarged head 142 at one end and threads on the remaining end to receive a nut 144. Each of the plates 136 and 138 has a circular portion **136*a* and 138*a*, respectively, located on opposite sides of the pulley 134. As shown clearly in FIGS. 16 and 18, the circular portion 138*a* of plate 138 has a peripheral segment removed to provide a straight surface 138*b***.

Each of the plates 136 and 138 is further provided with a tab 146 and 148, and a tongue 150 and 152 disposed diametrically relative to the tab. A hole **146*a* and 148*a* (FIG. 18) is provided in the respective tab 146 and 148, and a spacer 154 is positioned between the tabs and is fixed to tab 146. A bore 155 extends vertically through the spacer 154, as indicated by the broken lines in FIG. 17, the bore being aligned with the hole 146***a* in tab 146. At the other end of pulley assembly 132 a second spacer 156 is fixed to the tongue 152 and has a bore 158 extending transversely therethrough (FIG. 17). Spacers 154, 156 provide the correct separation between plates 136, 138 to ensure free rotation of the pulley 134 about the bolt 140.

Since the plate 138 is not fixed to spacers 154, 156, it is free to rotate about the bolt 140. To position plates 136, 138, hole 148*a* in tab 148 is aligned with bore 155 in spacer 154, and a beaded bolt 160 is inserted through the aligned apertures and held in place by a cotter pin 162 (FIGS. 1 and 17). Although not shown in the drawings, bolt 160 and cotter pin 162 are each attached to the descent pulley assembly 132, such as plate 136, by flexible elements to prevent their loss after separation.

An eyebolt 164, with an attachment ring 164*a* on one end, has an elongated body or rod portion 166 passing through the transverse bore 158 and terminates in an enlargement 168 at its interior end. A spring 170, compressed between enlargement 168 and the inner end surface of spacer 156, encircles rod portion 166 and biases the eyebolt 164 inwardly toward the pulley 134 (to the left in FIGS. 16–18). The body 166 of eyebolt 164 has a threaded portion 166*a* adjacent to the ring 164*a* meshing with a nut 172. Rod lengths 172*a* project transversely from nut 172 to facilitate rotation of the nut on the threaded portion 166*a*, similar to the "wings" on a wing nut. Under the urging of spring 170. eyebolt 164 is biased inwardly toward pulley 134, until nut 172 abuts the exterior surface of spacer 156. As is apparent from FIG. 17, the separation distance between pulley 134 and enlargement 168 may be adjusted by pulling on eyebolt 164 (to the right in FIGS. 16–18), adjusting the position of nut 172 on threaded portion 166*a*, and releasing the eyebolt. As long as any force on eyebolt 164 is less than or equal to the force of spring 170, the spring will maintain this separation distance. Since eyebolt rod 166 is slidable within transverse bore 158, eyebolt 164 freely reciprocates therein in response to such forces.

To install descent pulley assembly 132 onto descent cable 130 which, being anchored at both ends, does not permit installation via a cable end, the pulley assembly is "opened" by removing cotter pin 162 from bolt 160 and withdrawing the latter from bore 155 in the spacer 154, permitting plate 138 to be rotated, preferably counterclockwise, in the direction of arrow B in FIG. 16, to the position shown in FIG. 18. In this orientation, flat surface 138*b* along the periphery of plate 138 is substantially perpendicular to a horizontal line C extending through and joining the tab portion and the tongue of each plate 136, 138. By pulling on eyebolt 164, the descent cable 130 can be slipped between flat surface 138*b* and eyebolt enlargement 168, and onto pulley 134, after which the eyebolt is released.

To "close" pulley assembly 132, plate 138 is rotated clockwise (arrow D in FIG. 18) about pulley bolt 140, until hole 148*a* is aligned with spacer bore 155, and bolt 160 is reinserted and secured with cotter pin 162 to keep the pulley assembly on descent cable 130. Descent pulley assembly 132 may then be slid along cable 130 and held at a location convenient for use by worker W by adjusting the nut 172 in the manner described above until eyebolt enlargement 168 firmly engages cable 130. The force of spring 170 is sufficient to maintain this engagement.

In use, one of the flexible members 34, 42 attached to the end of main cable 18 is connected to ring 164*a* of eyebolt 164 and the remaining flexible member is connected to ring 40 on the worker's safety harness (FIG. 15). Then, as the worker W jumps or otherwise leaves his position, his weight will pull the eyebolt enlargement 168 away from the descent cable 130, compressing spring 170, permitting the descent pulley assembly 132 to move freely along the angled descent cable 130 to lower the worker at an angle away from the base of the structure. The controlled descent mechanism 10 or 210 operates as described above to lower the worker W at a controlled rate along the angled descent cable 130.

It is apparent from the drawings that since plate 138 is freely rotatable about bolt 140, it may be rotated either clockwise or counterclockwise during the foregoing procedure to place the pulley assembly 132 onto descent cable 130. The rotational directions described above result in the fastest procedure for mounting the pulley assembly.

It is within the comprehension of the invention that an alignment stop may be provided to quickly and mechanically align hole 148*a* in plate 138 with spacer bore 155 after pulley assembly 132 has been placed onto cable 130. As an example, a tang (not shown) or similar projection may extend vertically (outwardly from the place of the Figures) from tongue 150 of plate 136 and engage a lateral edge (the lower edge in FIGS. 16, 18) of tongue 152 on the rotatable plate 138 when hole 148*a* is aligned with bore 155. Equivalently, the tang may be carried on the tongue 152 of rotatable plate 138 to move therewith, and abut a lateral edge (e.g., the upper edge in FIGS. 16, 18) of the tongue 150 of the non-rotatable plate 138 when hole 148*a* is aligned with bore 155. Alternatively, instead of providing the stop tang on the tongue portions of the plates 136, 138, the tang may be provided on the tab portion of the plates, or the stop tang may otherwise be provided at a suitable location. Provision of an alignment stop will generally restrict unhindered, 360° rotation of the plate 138, and the location of the stop should be selected to permit the quickest "opening" and "closing" (as above described) of the pulley assembly 132 to place it onto the descent cable 130.

More than one eyebolt may be provided on descent pulley assembly 132 if desired and, for instance, may be secured to the spacer 156 and extend transversely therefrom to provide additional attachment points on the pulley assembly.

In the thus-described embodiments of the controlled descent mechanism of the present invention, the main or primary pulley over which the cable 18 passes, has been coupled to the centrifugally-operated brake system by a pawl-and-ratchet like clutch device. It is possible to directly couple the main pulley to the speed-multiplying gearing system and the centrifugally-operated braking mechanism, without an intervening clutch device. Due to the presence of the speed-multiplying gearing system, it is still possible for the cable 18 to pass through the controlled descent mechanism without undue restraint or hinderance of the worker W. The direct coupling of the main or drive pulley to the gearing system and the braking system may result in some additional wear of the braking element friction linings due to the possible constant engagement between the brake elements and the inner circumferential surface of the housing 50. Under normal operating conditions, the speed-multiplying gearing system will permit the cable 18 to pass through the controlled descent mechanism with a minimum of restraint resulting from this constant slight engagement between the brake elements and the housing surface. Under emergency or other rapid-descent conditions, the controlled descent mechanism operates as described above, to reduce the speed of descent to an acceptable, controlled rate.

Removal of the clutch mechanism and direct coupling of the drive pulley to the speed-multiplying gearing system and the brake system results in a controlled descent mechanism which is simpler mechanically, lighter in weight and less-expensive. This system is well suited for lighter weight ranges. Where heavier weights are anticipated during operation of the system, then the embodiments of the system which incorporate clutch coupling of the pulley to the gearing and brake systems is preferred.

Although the drive pulleys incorporating a U- or a V-shaped groove has been described in connection with the controlled descent mechanism in which the main cable 18 is wrapped around the drive pulley less than once, it is understood that either of these groove configurations could also be incorporated into the embodiment of FIGS. 1–7. Thus, for example, instead of the straight-sided and straight-bottom groove or recess for the pulley 62 shown in FIG. 2, a pair of U-shaped or V-shaped grooves could be provided for the pulley, with the cable wraps engaging the appropriate grooves.

The present invention offers many advantages over similar types of safety devices now in use. The main cable can be easily and quickly connected to the worker's safety harness, even with gloved hands, and thus encourages Since the present system can be quickly attached and detached from the safety harness, it is portable with the worker, and the same device can be used by different workers moving between different levels.

Another advantage is the easy maintenance and removal of foreign materials from the cable, the counterweight assembly, the controlled descent device and other components of the system. With the appropriate choices of sizes for the pulleys and rollers in the system, many different types and sizes of cables can be used.

With the system being designed for removable installation from the support, it may be removed relatively easily and stored when not in use to reduce exposure to adverse environments such as corrosive chemicals and seawater. This removability, combined with the use of corrosion-resistant materials, greatly prolongs the useful life of the system and significantly reduces maintenance requirements.

While the contemplated primary use of the present invention is not for the handling of working materials, in the event of an emergency, or if so desired, the system can be modified to raise and lower items of material by suitably providing the appropriate connections to the material and to both ends of the main cable. Although not specifically described herein or illustrated in the drawings, it is understood that all of the components described above are arranged and supported in an operative fashion to form a complete, operative system. Further, it is understood that all ancillary components have not been specifically described, but such components are known in the art and are appropriately incorporated into the operative system.

Of course, additional and other variations of the specific construction and arrangement of the climbing aid and safety descent system disclosed above can be made by those skilled in the art without departing from the invention as defined in the appended claims.

What is claimed is:

1. A climbing aid and safe descent system comprising:

(a) a cable having a first end portion adapted for removable connection to a user of the system and a second end portion attached to a counterweight;

(b) an elongated guide means secured at its ends and carraige means supporting said counterweight for movement along said guide means; and (c) a cable controller assembly including:

(i) a first pulley making rotatable contact with said cable;

(ii) centrifugally-actuated brake means; and (iii) means coupling said first pulley to said brake means, said coupling means in the cable controller assembly permitting free rotation of said first pulley and the concommitant free passage of said cable through said controller assembly at pulley rotational speeds below a predetermined value, and said coupling means coupling said first pulley to said brake means at pulley rotational speeds above said predetermined value, to restrict the pulley rotational speed and to restrict passage of said cable to a controlled rate.

2. The system of claim 1, wherein said coupling means includes a gearing system rotatably interconnecting said first pulley and said brake means.

3. The system of claim 1, wherein said gearing system comprises an arrangement of gears to multiply the rotational speed of said first pulley as applied to said brake means.

4. The system of claim 1, wherein said coupling means includes a centrifugally-actuated clutch means rotatably interconnecting said first pulley and said brake means.

5. The system of claim 2, wherein said coupling means further includes a centrifugally-actuated clutch means disposed between said first pulley and said gearing system.

6. The system of claim 5, wherein said clutch means includes first coupling means disposed for rotation with said first pulley and second coupling means disposed for rotation with said gearing system.

7. The system of claim 6, wherein said first coupling means comprises a pawl-like element pivotally supported at a point spaced from its rotational center, and said second coupling means comprises an engagement surface adapted for contact by said pawl-like element.

8. The system of claim 7, wherein said pawl-like element includes:

(a) a first portion having a surface adapted for contact with the engagement surface of said second coupling means;

(b) a second portion having a contoured surface; and (c) means to bias said first portion out of engaging contact with said second coupling means, said bias means and the off-center pivotal support of the pawl-like element cooperating to prevent engagement between said first and said second coupling means of said clutch means at pulley rotational speeds below said predetermined value, and at pulley rotational speeds above said value, the centrifugal force on said pawl-like element overcomes the force of said bias means to permit said pawl-like element to pivot into a position of engagement between said first portion and said second coupling means, to transmit pulley rotation to said gearing system.

9. The system of claim 8, wherein said second coupling means comprises a disk-like member having a plurality of said engagement surfaces angularly disposed adjacent to its periphery.

10. The system of claim 1, wherein said cable is disposed to make contact with the complete periphery of said first pulley.

11. The system of claim 1, wherein said cable controller assembly includes first and second rotatable guide means positioned relative to said first pulley to cause said cable to make contact with less than the full circumference of said pulley.

12. The system of claim 11, wherein said rotatable guide means are disposed such that said cable passes in parallel therebetween and contacts the periphery of said first pulley.

13. The system of claim 1 wherein said first pulley has a peripheral V-shaped groove in cross section to receive said cable.

14. The system of claim 13, wherein said first pulley has a friction element disposed in said groove for contact with said cable, said friction element being of a material providing minimum slip between said cable and said pulley.

15. The system of claim 1, wherein said first pulley has a peripheral U-shaped groove in cross section to receive said cable.

16. The system of claim 15, wherein said first pulley has a friction element disposed in said groove for contact with said cable, said friction element being of a material providing minimum slip between said cable and said pulley.

17. The system of claim 1, wherein said counterweight has an adjustable mass.

18. The system of claim 1, wherein said brake means includes a rotatably-disposed retainer and a brake element disposed within said retainer and moveable substantially only radially of said retainer upon retainer rotation to engage a portion of said cable controller assembly to restrict rotation of said first pulley.

19. The system of claim 18, wherein said brake element includes a friction surface engageable with a portion of said cable controller assembly.

20. The system of claim 1, further comprising:

(a) an elongated descent guide means anchored at its ends and disposed at an angle relative to the ground; and (b) guide pulley means adapted for attachment anywhere on said elongated descent guide means and moveable along the guide means after attachment, said first end portion of said cable having means for removable connection to the user and means for removable attachment to said guide pulley means.

21. The system of claim 20, wherein said guide pulley means comprises:

(a) a guide pulley rotatably supported on support means;

(b) gate means permitting placement of said guide pulley at any location along said descent guide means; and (c) adjustable attachment means for removably attaching said guide pulley means anywhere on said descent guide means.

22. The system of claim 21, wherein said support means includes a first plate upon which said guide pulley is rotatably supported, and said gate means includes a second plate disposed for rotation relative to said first plate and said guide pulley, said second plate rotatable from a first position to permit placement of said guide pulley on said descent guide means.

23. The system of claim 22, wherein:

said gate means further includes means for selectively fixing said second plate in said first position in which said guide pulley means is non-detachably but slidably positioned on said descent guide means; and said adjustable attachment means includes a spring-biased plunger having an engagement portion adjustably positionable relative to said guide pulley to grip said guide pulley means onto said descent guide means to prevent movement of said guide pulley means along said descent guide means.

24. A safety system which under normal-use conditions permits the free movement of the user and assists in the user's ascent between different elevations by counterbalancing a portion of the user's weight and which, under conditions of high descent rates, operates to restrict the descent rate to a lower, controlled rate, comprising, in combination:

(a) a cable having a first end portion adapted for removable connection to the user and a second end portion attached to a counterweight;

(b) carriage means supporting said counterweight for movement along an elongated guide member, said guide member being anchored at its ends, and said counterweight moving in a vertical direction substantially opposite to the vertical movement of the user, a component of said counterweight acting to counterbalance a portion of the user's weight; and (c) cable control means disposed intermediate the end portions of said cable, said cable control means comprising:

(i) a housing;

(ii) a first pulley rotatably disposed within said housing, said cable contacting the pulley in passing through said cable control means;

(iii) centrifugally-actuated brake means coaxially disposed relative to said first pulley and cooperating with said housing to provide a braking force; and (iv) means coupling said first pulley to said brake means and adapted to transmit rotation of said pulley to said brake means, said coupling means adapted to permit free rotation of said first pulley and the free passage of said cable through said cable control means at pulley rotational speeds below a predetermined value, and said coupling means coupling said first pulley to said brake means at pulley rotational speeds above said predetermined value, to restrict the pulley rotational speed and to restrict passage of said cable to a controlled rate.

25. The safety system of claim 24, wherein said coupling means includes a gearing system rotatably interconnecting said first pulley and said brake means, said gearing system comprising an arrangement of gears to multiply the rotational speed of said first pulley as applied to said brake means.

26. The safety system of claim 24, wherein said coupling means includes a centrifugally-actuated clutch means coaxially disposed relative to said pulley and said brake means and rotatably interconnecting said first pulley and said brake means.

27. The safety system of claim 24, wherein said cable control means is removably mounted on a support means.

28. The safety system of claim 24, wherein said cable is wrapped once around the periphery of said first pulley.

29. The safety system of claim 24, wherein said cable control means includes first and second rotatable guide means positioned relative to said first pulley to cause said cable to make contact with less than the full circumference of said pulley.

30. The safety system of claim 29, wherein said rotatable guide means are positioned such that said cable passes in parallel therebetween and contacts less than the full circumference of said first pulley.

31. The safety system of claim 24, wherein said first pulley has a peripheral V-shaped groove in cross section to receive said cable.

32. The safety system of claim 31, wherein said first pulley has a friction element disposed in said groove for contact with said cable, said friction element being of a material providing minimum slip between said cable and said pulley.

33. The safety system of claim 24, wherein said first pulley has a peripheral U-shaped groove in cross section to receive said cable.

34. The safety system of claim 33, wherein said first pulley has a friction element disposed in said groove for contact with said cable, said friction element being of a material providing minimum slip between said cable and said pulley.

35. The safety system of claim 24, wherein said first pulley has a peripheral groove to receive said cable, said groove having straight sides and bottom.

36. The safety system of claim 35, wherein the bottom of said groove is provided with a friction element for contact with said cable, said friction element being of a material providing minimum slip between said cable and said pulley.

37. The safety system of claim 24, wherein said counterweight mass is adjustable, and may be adjusted to be less than, equal to, or greater than the weight of the system user.

38. The safety system of claim 24, wherein said brake means includes a rotatably-disposed retainer and a brake element disposed within said retainer and moveable substantially only radially of said retainer upon retainer rotation to engage said housing to restrict rotation of said first pulley.

39. The safety system of claim 25, wherein said coupling means further includes a centrifugally-actuated clutch means coaxially disposed between said first pulley and said gearing system.

40. The safety system of claim 39, wherein said clutch means includes:

(a) first coupling means disposed for rotation with said first pulley, comprising a pawl-like member pivotally supported on said pulley, said member having a contact surface on a first portion;

(b) second coupling means disposed coaxially relative to said first pulley and rotatable with said gearing system, comprising a disk-like member having a plurality of engagement surfaces angularly disposed adjacent to its periphery for contact by said pawl-like member; and (c) means on said first pulley to bias said first portion out of engaging contact with said second coupling means, said bias means operative to prevent engagement between said first and said second coupling means at pulley rotational speeds below said predetermined value, and at pulley rotational speeds above said value, the centrifugal force on said pawl-like member overcomes the force of said bias means to permit said pawl-like member to pivot into a position of engagement between said contact surface on said first portion and an engagement surface on said second coupling means, to transmit pulley rotation to said gearing system.

41. The safety system of claim 40, wherein said brake means includes a rotatably-disposed retainer and a brake element disposed within said retainer and moveable substantially only radially of said retainer upon retainer rotation to engage said housing to restrict rotation of said first pulley.

42. The safety system of claim 24, further comprising:

(a) a descent guide cable anchored at its ends and disposed at an angle relative to the ground; and (b) a guide pulley assembly adapted for attachment anywhere on said descent guide cable and moveable along said guide cable after attachment;

said first end portion of said cable having means for removable connection to the user and means for removable attachment to said guide pulley assembly, to permit the descent of the user along said descent guide cable, at a lower controlled rate and at an angle to the ground.

43. The safety system of claim 42, wherein said guide pulley assembly comprises:

(a) a guide pulley rotatably disposed on support means;

(b) gate means permitting placement of said guide pulley at any location along said descent guide cable; and (c) adjustable attachment means for removably attaching said guide pulley assembly anywhere on said descent guide cable.

44. The safety system of claim 43, wherein said support means includes a first plate upon which said guide pulley is rotatably supported, and said gate means includes a second plate disposed for rotation relative to said first plate and said guide pulley, said second plate rotatable from a first position to permit placement of said guide pulley on said descent guide cable.

45. The safety system of claim 44, wherein said gate means further includes means for selectively fixing said second plate in said first position in which said guide pulley assembly is non-detachably but slidably positioned on said descent guide cable, and said adjustable attachment means includes a spring-biased plunger having an engagement portion adjustably positionable relative to said guide pulley to grip said guide pulley assembly onto said descent guide cable to prevent movement of said guide pulley assembly along said descent guide cable.

46. The safety system of claim 45, wherein said second plate includes a circular portion disposed adjacent said guide pulley, said circular portion having a linear surface defined along a chord of the circle, such that when said second plate is rotated from said first position said linear surface permits entry of said descent guide cable into said guide pulley.

47. A pulley assembly adapted for placement on a cable anchored at its ends, comprising:

(a) a first plate having a pulley rotatably disposed thereon;

(b) a second plate disposed substantially parallel to said first plate and rotatable relative to said first plate and said pulley;

(c) gate means cooperating with the rotation of second plate to permit placement of the pulley onto the cable at any location along the cable; and (d) adjustable attachment means for removably attaching the pulley assembly at any location along the cable.

48. The pulley assembly of claim 47, wherein said adjustable attachment means includes:

(a) a spring-biased plunger;

(b) means slidably supporting said plunger on said first plate; and (c) adjustment means for selectively positioning an end portion of said plunger relative to said pulley.

49. The pulley assembly of claim 48, wherein said second plate includes a circular portion disposed adjacent said pulley, said circular portion having a linear surface defined along a chord of the circle, and said second plate rotatable from a first position to a second position where at said linear surface permits receiving placement of said pulley on the cable.

50. The pulley assembly of claim 49, wherein said gate means comprises:

(a) a first tab on said first plate, coplanar with said first plate, said plunger support means being disposed on said first tab;

(b) a first lateral extension on said second plate, coplanar with said circular portion of the second plate and angularly spaced peripherally from the linear surface on said second plate; and (c) removable securing means for maintaining said first lateral extension on the second plate vertically aligned with said first tab on the first plate, thereby confining the cable on said pulley between said first and said second plates.

51. The pulley assembly of claim 50, wherein said first position of said second plate is defined by the vertical alignment of said first lateral extension on the second plate with said first tab on the first plate, said second position of said second plate is defined by said linear surface on the second plate being located substantially vertically above said first tab on the first plate, and said removably securing means includes removable means insertable in apertures in said first and said second plates, said apertures being vertically aligned with the second plate in said first position.

52. The pulley assembly of claim 51, further comprising:

(a) a spacer disposed on the first tab of said first plate and adapted to vertically separate said first plate from said second plate, said plunger being slidably disposed on said spacer; and (b) abutment means adjustably supported on said plunger and cooperating with said spacer to maintain, against the force of the plunger-biasing spring, an end portion of said plunger at a selected position from said pulley, said abutment means being adjustable to permit said plunger to be adjusted into gripping contact with the cable on said pulley to position the pulley assembly at any location along the cable, said abutment means movable with said plunger away from said spacer to move said plunger end portion from said pulley.

53. The pulley assembly of claim 52, further comprising a second spacer angularly spaced from said spacer along the periphery of said pulley and disposed between said first and said second plates, said removable securing means receivable in a bore in said second spacer.

* * * * *